US010529292B2

(12) United States Patent
Shim

(10) Patent No.: US 10,529,292 B2
(45) Date of Patent: Jan. 7, 2020

(54) METHOD OF DRIVING DISPLAY PANEL AND DISPLAY APPARATUS FOR PERFORMING THE SAME

(71) Applicant: SAMSUNG DISPLAY CO., LTD., Yongin-si, Gyeonggi-Do (KR)

(72) Inventor: Chanwook Shim, Asan-si (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 324 days.

(21) Appl. No.: 15/497,354

(22) Filed: Apr. 26, 2017

(65) Prior Publication Data

US 2017/0316748 A1 Nov. 2, 2017

(30) Foreign Application Priority Data

Apr. 27, 2016 (KR) ..... 10-2016-0051795

(51) Int. Cl.
*G09G 3/36* (2006.01)

(52) U.S. Cl.
CPC ..... *G09G 3/3607* (2013.01); *G09G 3/3674* (2013.01); *G09G 3/3685* (2013.01); *G09G 2300/0426* (2013.01); *G09G 2310/0251* (2013.01); *G09G 2310/06* (2013.01); *G09G 2310/08* (2013.01)

(58) Field of Classification Search
CPC ..... G09G 3/3607; G09G 3/3648; G09G 3/3674–3677; G09G 2310/06; G09G 2310/066; G09G 2320/0223; G09G 2320/0673
See application file for complete search history.

(56) References Cited

U.S. PATENT DOCUMENTS

2013/0321386 A1* 12/2013 Murai ..... G09G 3/3648 345/213
2015/0154900 A1* 6/2015 Zhang ..... G09G 3/20 345/215

FOREIGN PATENT DOCUMENTS

KR 10-2011-0067355 6/2011
KR 10-2015-0042088 4/2015

* cited by examiner

*Primary Examiner* — Michael Pervan
(74) *Attorney, Agent, or Firm* — F. Chau & Associates, LLC

(57) ABSTRACT

A method of driving a display panel and a display apparatus having a plurality of gate lines and a plurality of data lines that cross the gate lines. The method includes determining whether to compensate a gate signal or not according to input image data displayed on a display panel, transmitting a first gate signal having a first falling waveform to a first gate line and a second gate signal having a second falling waveform different from the first falling waveform to the second gate line. A first gate clock signal may be adjusted when the gate signal is determined to be compensated. A timing controller may compensate the first gate signal when an artifact would be displayed based on a variation in brightness when a first subpixel row to which the first gate signal is applied is brighter than a second subpixel row for a same target luminance.

23 Claims, 13 Drawing Sheets

METHOD OF DRIVING DISPLAY PANEL AND DISPLAY APPARATUS FOR PERFORMING THE SAME

CROSS-REFERENCE TO RELATED APPLICATIONS

This application claims priority under 35 U.S.C. § 119 from Korean Patent Application No. 10-2016-0051795, filed on Apr. 27, 2016 in the Korean Intellectual Property Office, the contents of which are incorporated by reference herein.

1. TECHNICAL FIELD

Exemplary embodiments of the present inventive concept relate to a method of driving a display panel and a display apparatus for performing the method.

2. DISCUSSION OF THE RELATED ART

A display apparatus may include a display panel and a display panel driver. The display panel driver includes a timing controller, a gate driver and a data driver. The timing controller, for example, controls driving the timings of the gate driver and the data driver. The gate driver outputs a gate signal to a gate line. The data driver outputs a data voltage to a data line.

When the display panel displays a specific pattern, the data voltages applied to some of the data lines may swing between a high grayscale level and a low grayscale level, whereas the data voltages applied to other data lines may maintain the high grayscale level.

In addition, a subpixel connected to a data line having the data voltage swinging between the high grayscale level and the low grayscale level may have a charging rate that is different from a charging rate of a subpixel connected to a data line having the data voltage maintaining the high grayscale level for the same target grayscale level. A display artifact (e.g. distortion) may be generated due to the different charging rates between the subpixels.

SUMMARY

Exemplary embodiments of the present inventive concept provide a method of driving a display panel that may include adjusting a waveform of a gate signal according to input image data to increase a display quality.

Exemplary embodiments of the present inventive concept may also provide a display apparatus for performing the above-mentioned method.

In an exemplary embodiment of a method of driving a display panel according to the present inventive concept, the method may include the operations of determining whether to compensate a first gate signal according to an input image data displayed on a display panel, transmitting the first gate signal having a first falling waveform to a first gate line and a second gate signal having a second falling waveform differently set from the first falling waveform to a second gate line, including adjusting the first falling waveform of the first gate signal in response to determining the first gate signal is to be compensated, and transmitting data voltages to a plurality of data lines.

In an exemplary embodiment of the present inventive concept, the first and second gate lines extend in a first direction and the plurality of data lines extend in a second direction crossing the first direction, and determining whether to compensate the first gate signal includes identifying when the input image data generates a display artifact having an artifact pattern extending in the first direction of the first and second gate lines.

In an embodiment of the inventive concept, adjusting the first falling waveform of the first gate signal includes changing a first gate clock signal having the first falling waveform to prolong a duration in which the first falling waveform changes from a high level to a low level.

In an exemplary embodiment of the present inventive concept, the display panel may include a red subpixel column configured to represent a red color, a green subpixel column configured to represent a green color, and a blue subpixel column configured to represent a blue color. A single data line of the display panel may be alternately connected to subpixels in two adjacent subpixel columns. The gate signal may be determined to be compensated, for example, when the input image data represents one of a yellow image, a cyan image and a magenta image.

In an exemplary embodiment of the present inventive concept, the first gate signal having the first falling waveform may be generated based on a first gate clock signal having the first falling waveform. The second gate signal having the second falling waveform may be generated based on a second gate clock signal having the second falling waveform.

In an exemplary embodiment of the present inventive concept, the first falling waveform of the first gate clock signal may be determined by a first charge sharing period when the first gate clock signal falls. The second falling waveform of the second gate clock signal may be determined by a second charge sharing period when the second gate clock signal falls.

In an embodiment of the inventive concept, the first charge sharing period may have a different duration than the second charge sharing period.

In an exemplary embodiment of the present inventive concept, the first falling waveform may fall from a high level to a low level in a moment (e.g. a substantially stepless drop from the high level to the low level at substantially a same point in time) and the second falling waveform may fall from the high level to an intermediate level and from the intermediate level to the low level in a step shape when a first subpixel row to which the first gate signal is applied is brighter than a second subpixel row to which the second gate signal is applied for a same target luminance.

In an exemplary embodiment of the present inventive concept, the first falling waveform may fall from a high level to an intermediate level and from the intermediate level to a low level in a step shape in a first duration and the second falling waveform may fall from the high level to the intermediate level and from the intermediate level to the low level in a step shape in a second duration which is longer than the first duration when a first subpixel row to which the first gate signal is applied is brighter than a second subpixel row to which the second gate signal is applied for a same target luminance.

In an exemplary embodiment of the present inventive concept, the first gate signal may have a first rising waveform. The second gate signal may have a second rising waveform different from the first rising waveform.

In an exemplary embodiment of the present inventive concept, the first rising waveform may be symmetrical with the first falling waveform. The second rising waveform may be symmetrical with the second falling waveform.

In an exemplary embodiment of a display apparatus according to the present inventive concept, the display apparatus may includes a display panel, a timing controller, a gate driver and a data driver. The display panel includes a plurality of gate lines, a plurality of data lines and a plurality of subpixels connected to the gate lines and the data lines. The timing controller is configured to determine to compensate a gate signal or not according to input image data displayed on the display panel. The gate driver is configured to output a first gate signal having a first falling waveform to a first gate signal and a second gate signal having a second falling waveform different from the first falling waveform when the gate signal is determined to be compensated. The data driver is configured to output a data voltage to the data lines.

In an exemplary embodiment of the present inventive concept, the timing controller may be configured to determine compensation of the gate signal in response to the input image data generating a display artifact having an artifact pattern extending in a direction of the first and second gate lines.

In an exemplary embodiment of the present inventive concept, the display panel may include a red subpixel column configured to represent a red color, a green subpixel column configured to represent a green color, and a blue subpixel column configured to represent a blue color. A single data line of the display panel may be alternately connected to the respective subpixels in two adjacent subpixel columns. The timing controller may be configured to determine to compensate the gate signal, for example, when the input image data represents one of a yellow image, a cyan image and a magenta image.

In an exemplary embodiment of the present inventive concept, the first gate signal having the first falling waveform may be generated based on a first gate clock signal having the first falling waveform. The second gate signal having the second falling waveform may be generated based on a second gate clock signal having the second falling waveform.

In an exemplary embodiment of the present inventive concept, the first falling waveform of the first gate clock signal may be determined by a first charge sharing period when the first gate clock signal falls. The second falling waveform of the second gate clock signal may be determined by a second charge sharing period when the second gate clock signal falls.

In an exemplary embodiment of the present inventive concept, the first falling waveform may fall from a high level to a low level in a moment (e.g. a substantially stepless drop) and the second falling waveform may fall from the high level to an intermediate level and from the intermediate level to the low level in a step shape when a first subpixel row to which the first gate signal is applied is brighter than a second subpixel row to which the second gate signal is applied for a same target luminance.

In an exemplary embodiment of the present inventive concept, the first falling waveform may fall from a high level to an intermediate level and from the intermediate level to a low level in a step shape having a first duration and the second falling waveform may fall from the high level to the intermediate level and from the intermediate level to the low level in a step shape having a second duration which is longer than the first duration when a first subpixel row to which the first gate signal is applied is brighter than a second subpixel row to which the second gate signal is applied for a same target luminance.

In an exemplary embodiment of the present inventive concept, the first gate signal may have a first rising waveform. The second gate signal may have a second rising waveform different from the first rising waveform.

In an exemplary embodiment of the present inventive concept, the first rising waveform may be symmetrical with the first falling waveform. The second rising waveform may be symmetrical with the second falling waveform.

According to the method of driving the display panel and the display apparatus for performing the method, the waveform of the gate signal applied to the gate line is adjusted according to the input image data so that the display artifact due to the difference of the charging rates between the subpixels may be prevented. Thus, the display quality of the display panel may be increased.

In an embodiment of the present inventive concept, a display may include a display panel comprising a plurality of gate lines extending in a first direction, a plurality of data lines extending in a second direction crossing the first direction, and a plurality of subpixels connected to the gate lines and the data lines, a timing controller including an image compensation unit and a signal generator, the signal generator is configured to generate at least a first gate clock signal and a second gate clock signal, and the image compensation unit compensates an input image data to generate a data signal, a gate driver configured to generate a first gate signal and a second gate signal output to respective rows of subpixels in response to receiving the first gate clock signal and the second gate clock signal from the signal generator, a data driver that receives the data signal generated by the image compensation unit and a control signal from the timing controller and converts the data signal into data voltages output to the plurality of data lines. The first gate signal includes a first rising waveform and a first falling waveform, and the second gate signal includes a second rising waveform and a second falling waveform, and the timing controller may adjusts a rising charge sharing period of the first rising waveform by outputting the first clock signal to rise from a low level to an intermediate level during a first duration of time and from the intermediate level to a high level in a step shape during a second duration of time when the timing controller determines that a first subpixel row to which the first gate signal is applied is brighter than a second subpixel row to which the second gate signal is applied for a same target luminance.

In an embodiment of the inventive concept, both a rising charge sharing period and a falling charge sharing period may be adjusted.

BRIEF DESCRIPTION OF THE DRAWINGS

The present inventive concept will become more apparent by describing in detail one or more exemplary embodiments thereof with reference to the accompanying drawings, in which.

DETAILED DESCRIPTION

Hereinafter, the present inventive concept will be explained in detail with reference to the accompanying drawings.

Figure 1:
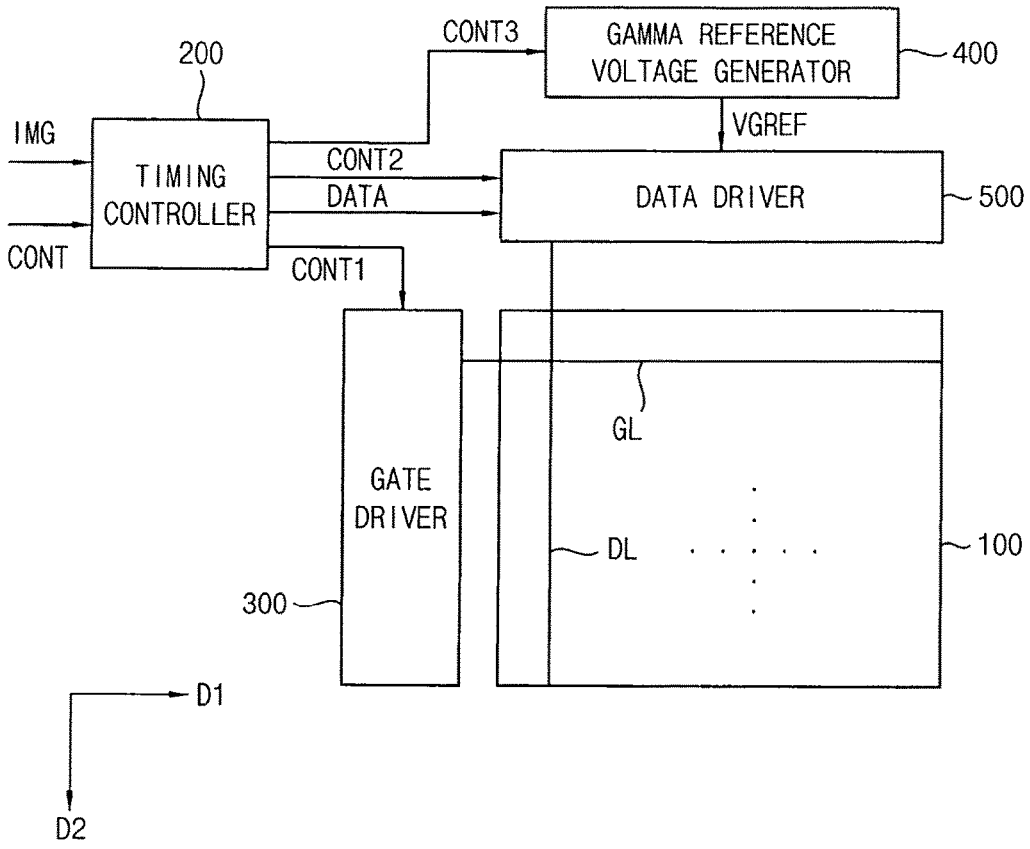
FIG. 1 is a block diagram illustrating a display apparatus according to an exemplary embodiment of the present inventive concept.

FIG. 1 is a block diagram illustrating a display apparatus according to an exemplary embodiment of the present inventive concept.

Referring to FIG. 1, the display apparatus may include, for example, a display panel 100 and a display panel driver. The display panel driver may include a timing controller 200, a gate driver 300, a gamma reference voltage generator 400 and a data driver 500.

The display panel 100 has a display region in which a plurality of subpixels are disposed. An image may be displayed in the display region. In addition, there may be a peripheral region adjacent to the display region. The peripheral region is outside the display area in which the image is displayed.

The display panel 100 includes a plurality of gate lines GL, a plurality of data lines DL and the plurality of subpixels are electrically connected to the gate lines GL and the data lines DL. The gate lines GL may extend in a first direction D1 and the data lines DL may extend in a second direction D2 crossing the gate lines GL extending in the first direction D1. In the case of a liquid crystal display, the display area DA includes a liquid crystal capacitor, and the liquid crystal capacitor includes, for example, a pixel electrode, a common electrode, and a liquid crystal layer.

Each subpixel includes a switching element and a liquid crystal capacitor. The liquid crystal capacitor is electrically connected to the switching element. The subpixels may be disposed in a matrix form.

The structure of the display panel 100 may be explained in more detail with reference to FIGS. 1 and 2A to 2C.

The timing controller 200 may receive an input image data IMG and an input control signal CONT from an external apparatus (not shown). The input image data IMG may include, for example, red image data, green image data and blue image data. The input control signal CONT may include a master clock signal and a data enable signal. The input control signal CONT may further include a vertical synchronizing signal and a horizontal synchronizing signal.

The timing controller 200 may generate a first control signal CONT1, a second control signal CONT2, a third control signal CONT3 and a data signal DATA based on the input image data IMG and the input control signal CONT.

More particularly, the timing controller 200 may generate the first control signal CONT1 for controlling an operation of the gate driver 300 based on the input control signal CONT, and outputs the first control signal CONT1 to the gate driver 300. The first control signal CONT1 may further include a vertical start signal and a gate clock signal.

In addition, the timing controller 200 may generate the second control signal CONT2 for controlling an operation of the data driver 500 based on the input control signal CONT, and outputs the second control signal CONT2 to the data driver 500. The second control signal CONT2 may include a horizontal start signal and a load signal.

The timing controller 200 may also generate the data signal DATA based on the input image data IMG. The timing controller 200 outputs the data signal DATA to the data driver 500.

The timing controller 200 may generate the third control signal CONT3 for controlling an operation of the gamma reference voltage generator 400 based on the input control signal CONT, and outputs the third control signal CONT3 to the gamma reference voltage generator 400.

The structure and the operation of the timing controller 200 may be explained in more detail with reference to FIGS. 1, 5 and 6.

The gate driver 300 generates gate signals driving the plurality of gate lines GL in response to the first control signal CONT1 received from the timing controller 200. The gate driver 300 may sequentially output the gate signals to the plurality of gate lines GL.

The gate driver 300 may be directly mounted on the display panel 100, or may be connected to the display panel 100, for example, as a tape carrier package (TCP) type. Alternatively, the gate driver 300 may be integrated on the display panel 100.

The gamma reference voltage generator 400 may generate a gamma reference voltage VGREF in response to the third control signal CONT3 being received from the timing controller 200. The gamma reference voltage may be provided for dynamic gamma correction in the display panel. The gamma reference voltage generator 400 provides the gamma reference voltage VGREF to the data driver 500. The gamma reference voltage VGREF has a value corresponding to a level of the data signal DATA.

In an exemplary embodiment of the present inventive concept, the gamma reference voltage generator 400 may be disposed in, for example, the timing controller 200, or in the data driver 500.

The data driver 500 receives the second control signal CONT2 and the data signal DATA from the timing controller 200, and receives the gamma reference voltages VGREF from the gamma reference voltage generator 400. The data driver 500 converts the data signal DATA into data voltages having an analog type using the gamma reference voltages VGREF. The data driver 500 outputs the data voltages to the plurality of data lines DL.

The data driver 500 may be directly mounted on the display panel 100, or be connected to the display panel 100 in a TCP type. Alternatively, the data driver 500 may be integrated on the display panel 100.

Figure 2A:
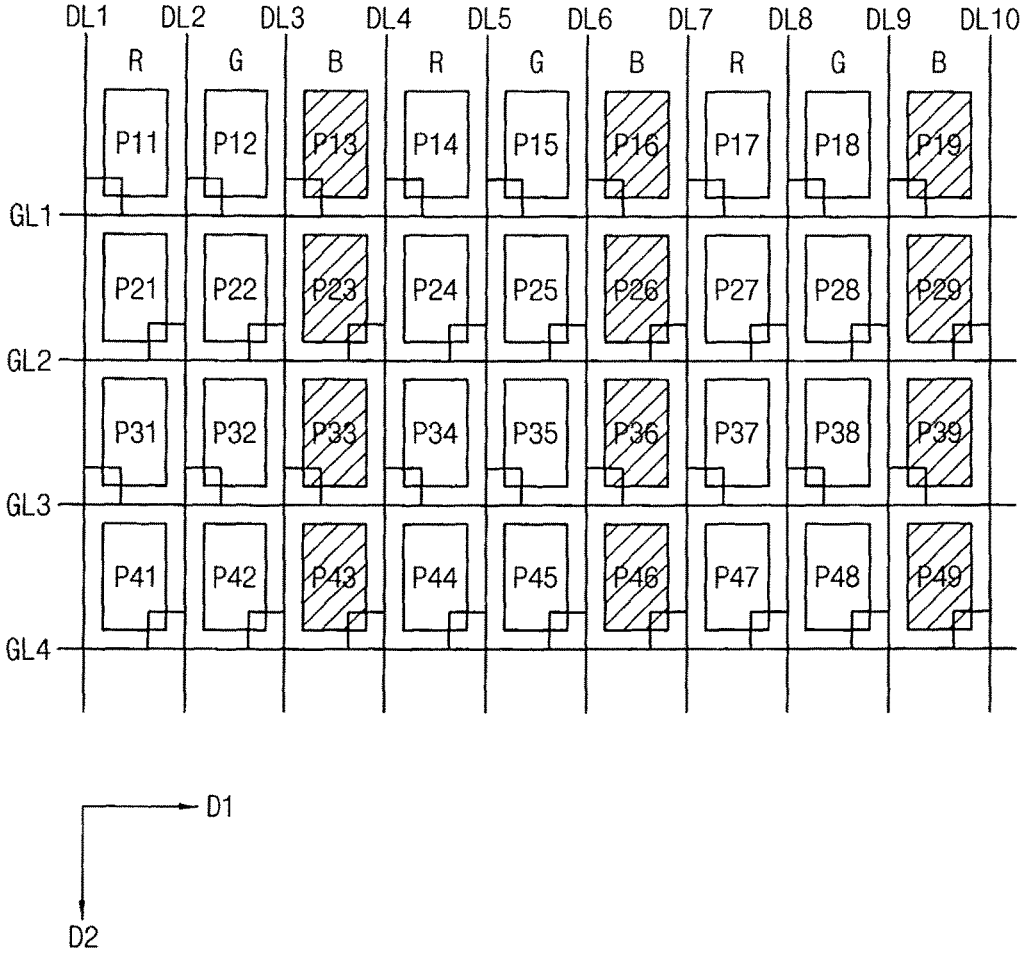
FIG. 2A is a conceptual diagram illustrating a display panel of FIG. 1 including an array of pixels displaying a yellow image.
Figure 2B:
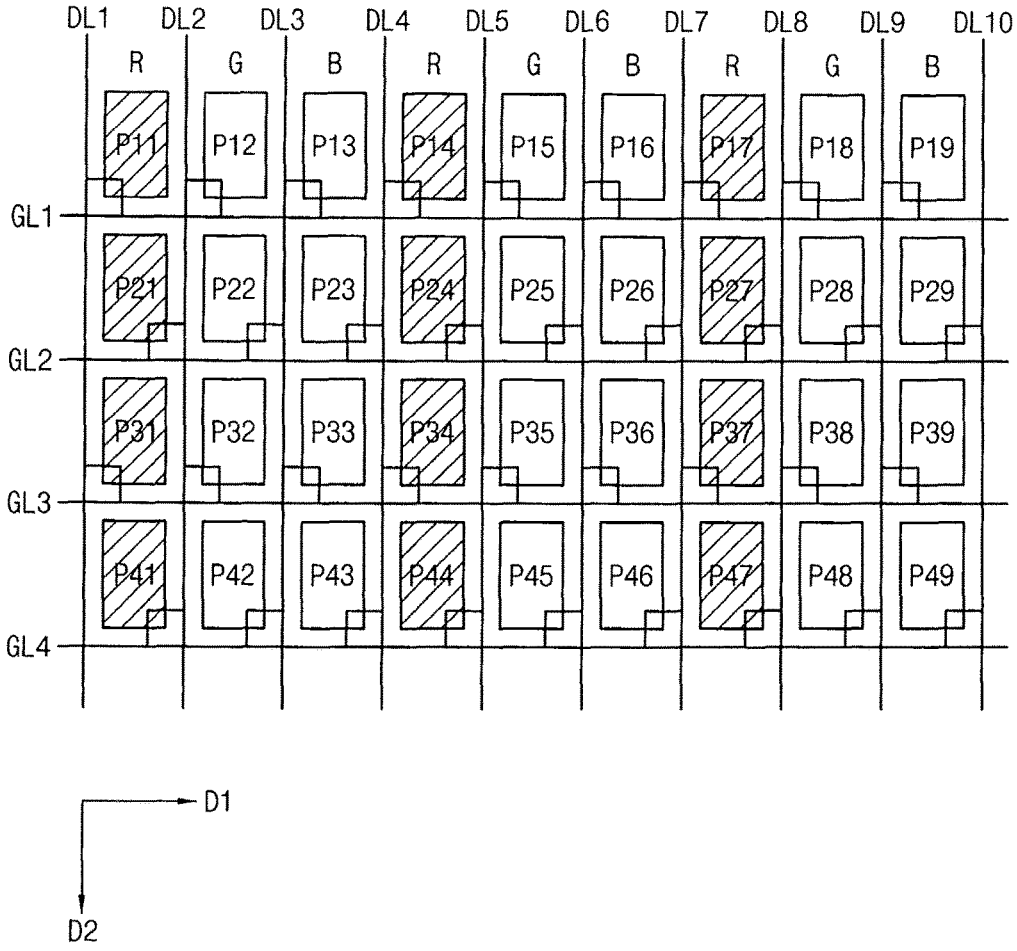
FIG. 2B is a conceptual diagram illustrating the display panel of FIG. 1 including an array of pixels displaying a cyan image.
Figure 2C:
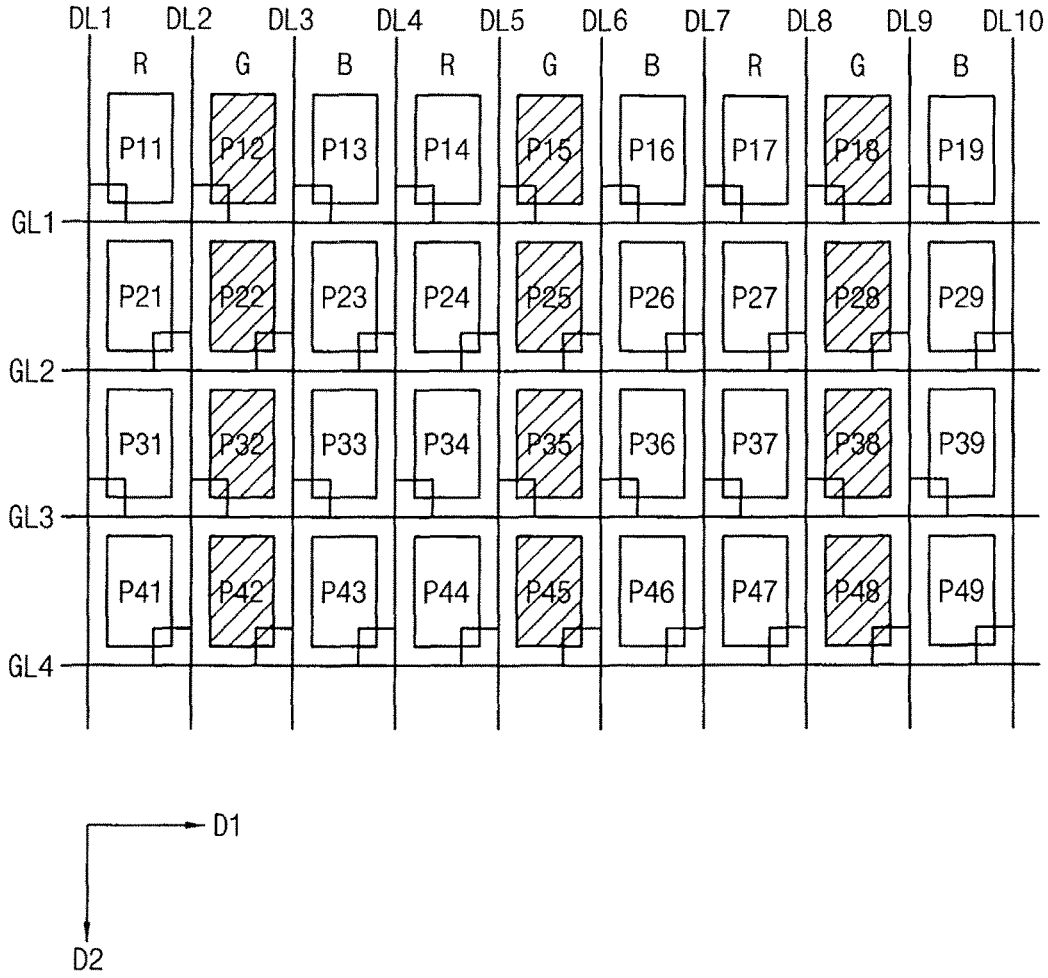
FIG. 2C is a conceptual diagram illustrating the display panel of FIG. 1 including an array of pixels displaying a magenta image.

FIG. 2A is a conceptual diagram illustrating a display panel of FIG. 1 displaying a yellow image. FIG. 2B is a conceptual diagram illustrating the display panel of FIG. 1 displaying a cyan image. FIG. 2C is a conceptual diagram illustrating the display panel of FIG. 1 displaying a magenta image.

Referring to FIGS. 1 to 2C, when the input image data IMG generate luminance difference due to the difference of charging rates between the subpixels, the timing controller 200 may determine to compensate the gate signal. For example, when the input image data IMG generates a display artifact having an artifact pattern extending in a direction of the gate line GL, the timing controller 200 may determine to compensate the gate signal.

When the input image data IMG do not generate the luminance difference due to the difference of charging rates between the subpixels, the timing controller 200 may determine that the gate signal should not be compensated. As previously discussed herein, the generation of an artifact may occur based on a luminance difference of charging rates between the subpixels, for example, when one subpixel is changing between low gray scale and high grayscale levels, whereas a charging rate of another subpixel connected to a data line has a data voltage that maintains a high grayscale level for the same target grayscale level. For example, when the input image data IMG do not generate the display artifact having the artifact pattern extending in a direction of the gate line GL, the timing controller 200 may determine not to compensate the gate signal. When the gate signals are not compensated, the gate signals output to the display panel 100 may have the same rising waveforms as one another and the same falling waveforms as one another.

In FIGS. 2A to 2C, the input image data IMG displayed on the display panel 100 may generate the horizontal line artifact.

The display panel 100 includes a plurality of subpixels. The subpixels may form a subpixel row in the first direction D1 and may form a subpixel column in the second direction D2.

The gate line GL is connected to subpixels in the subpixel row disposed in a first side with respect to the gate line GL. The single gate line GL, such as shown in FIG. 1, is connected to the subpixels in the single subpixel row.

For example, referring to FIG. 2A, a first gate line GL1 is connected to subpixels P11, P12, P13, P14, P15, P16, P17, P18 and P19 in a first subpixel row. For example, a second gate line GL2 is connected to subpixels P21, P22, P23, P24, P25, P26, P27, P28 and P29 in a second subpixel row. For example, a third gate line GL3 is connected to subpixels P31, P32, P33, P34, P35, P36, P37, P38 and P39 in a third subpixel row. For example, a fourth gate line GL4 is connected to subpixels P41, P42, P43, P44, P45, P46, P47, P48 and P49 in a fourth subpixel row.

However, with regard to the pixel columns, FIGS. 2A-2C shows that the data line DL (e.g. DL1-DL8) is alternately connected to subpixels in a subpixel column disposed in a first side with respect to the data line DL and subpixels in a subpixel column disposed in a second side with respect to the data line DL.

For example, a second data line DL2 is alternately connected to a first subpixel P12 in a second subpixel column, a second subpixel P21 in a first subpixel column, a third subpixel P32 in the second subpixel column, and a fourth subpixel P41 in the first subpixel column. Thus, the connection to data line DL2 alternates between a subpixels from column of red subpixels and subpixels from a column of green subpixels, such as shown in FIG. 2A.

In another example, a third data line DL3 is alternately connected to a first subpixel P13 in a third subpixel column, a second subpixel P22 in the second subpixel column, a third subpixel P33 in the third subpixel column, and a fourth subpixel P42 in the second subpixel column. Thus, the connection to the data line DL3, as shown in FIG. 2A, alternates between subpixels from a column of green subpixels, and subpixels from a column of blue subpixels.

In yet another example, a fourth data line DL4 is alternately connected to a first subpixel P14 in a fourth subpixel column, a second subpixel P23 in the third subpixel column, a third subpixel P34 in the fourth subpixel column, and a fourth subpixel P43 in the third subpixel column. Thus, the connection to the data line DL4, as shown in FIG. 2A, alternates between subpixels from a column of blue subpixels, and subpixels from a column of red subpixels.

Data voltages having opposite polarities may be applied to the adjacent data lines. In addition, the data voltage may be inverted in every frame. For example, during a first frame, the positive data voltages (+) are applied to first, third, fifth and seventh data lines DL1, DL3, DL5 and DL7 and the negative data (−) voltages are applied to second, fourth, sixth and eighth data lines DL2, DL4, DL6 and DL8. During a second frame, the negative data voltages (−) are applied to the first, third, fifth and seventh data lines DL1, DL3, DL5 and DL7 and the positive data voltages (+) are applied to the second, fourth, sixth and eighth data lines DL2, DL4, DL6 and DL8, and the inversion can occur at each frame.

Therefore, the subpixels of the display panel 100 are driven in a dot inversion method using a column inversion method of the data lines.

For example, with reference to FIGS. 2A to 2C, a first subpixel column may be a red subpixel column R including red subpixels. A second subpixel column may be a green subpixel column G including green subpixels. A third subpixel column may be a blue subpixel column B including blue subpixels. The sequence of columns of RBG may then repeat. For example, a fourth subpixel column may be a red subpixel column R including red subpixels, a fifth subpixel column may be a green subpixel column G including green subpixels, a sixth subpixel column may be a blue subpixel column B including blue subpixels, a seventh subpixel column may be a red subpixel column R including red subpixels, an eighth subpixel column may be a green subpixel column G including green subpixels, and a ninth subpixel column may be a blue subpixel column B including blue subpixels.

Although subpixels in four subpixel rows and nine subpixel columns are illustrated in FIGS. 2A to 2C for convenience of explanation, the display panel 100 may include more subpixels than shown, for example, more than four subpixel rows and/or more than nine subpixel columns.

In FIG. 2A, the display panel 100 may display a yellow image. For example, the red subpixel columns R and the green subpixel columns G may display a high grayscale level. For example, the blue subpixel columns B may display a low grayscale level.

The second data line DL2 is alternately connected to the first subpixel columns which is the red subpixel columns R and the second subpixel columns which is the green subpixel columns G so that the data voltage outputted through the second data line DL2 maintains a high grayscale level.

In contrast, the third data line DL3 is alternately connected to the second subpixel column which is the green subpixel column G and the third subpixel column which is the blue subpixel column B so that the data voltage outputted through the third data line DL3 swings between a high grayscale level and a low grayscale level.

With continued reference to FIG. 2A, the green subpixels P12 and P32 connected to the second data line DL2, which outputs a data voltage maintaining a high grayscale level have charging rates greater than charging rates of the green subpixels P22 and P42 connected to the third data line DL3, which outputs a data voltage swinging between a high grayscale level and a low grayscale level when the green subpixels P12 and P32 connected to the second data line DL2 and the green subpixels P22 and P42 connected to the third data line DL3 have the same target grayscale level. The different charging rates of the subpixels may result in different levels for brightness for the subpixels connected to the different data lines.

For example, the green subpixels P12 and P32 connected to the second data line DL2 may be brighter than the green subpixels P22 and P42 connected to the third data line DL3 for the same target grayscale level. Therefore, the green subpixels P12, P15, P18, P32, P35 and P38 in the first and third subpixel rows are brighter than the green subpixels P22, P25, P28, P42, P45 and P48 in the second and fourth subpixel rows for the same target grayscale level.

In addition, the fourth data line DL4 shown in FIG. 2A is alternately connected to the third subpixel column (which is the blue subpixel column B), and the fourth subpixel column (which is the red subpixel column R), so that in this example the data voltage outputted through the fourth data line DL4 swings between a high grayscale level and a low grayscale level.

In contrast, the fifth data line DL5 shown in FIG. 2A is alternately connected to the fourth subpixel column which is the red subpixel columns R and the fifth subpixel column which is the green subpixel columns G so that the data voltage outputted through the fifth data line DL5 maintains a high grayscale level.

The red subpixels P24 and P44 connected to the fifth data line DL5 which outputs a data voltage maintaining a high grayscale level have charging rates greater than charging rates of the red subpixels P14 and P34 connected to the fourth data line DL4 which outputs a data voltage swinging between a high grayscale level and a low grayscale level when the red subpixels P24 and P44 connected to the fifth data line DL5 and the red subpixels P14 and P34 connected to the fourth data line DL4 have the same target grayscale level. Thus, the red subpixels P24 and P44 connected to the fifth data line DL5 may be brighter than the red subpixels P14 and P34 connected to the fourth data line DL4 for the same target grayscale level because the voltage is maintained at a high grayscale level and for P14 and P34 whereas the voltage swings between a high grayscale and low gray scale for red pixels P14 and P34 because DL4 is connected to blue (low grayscale) and red (high grayscale) levels. Therefore, the red subpixels P24, P27, P44 and P47 in the second and fourth subpixel rows are brighter than the red subpixels P14, P17, P34 and P37 in the first and third subpixel rows for the same target grayscale level.

The relatively brighter green subpixels P12, P15, P18, P32, P35 and P38 in the first and third subpixel rows may generate a horizontal line artifact. The relatively brighter green subpixels P24, P27, P44 and P47 in the second and fourth subpixel rows may generate a horizontal line artifact. Among red, green and blue, the color green is the most significant factor to luminance of the image to a human eye. A next significant factor to the luminance of the image to the human eye is red and the least significant factor to the luminance of the image to the human eye is blue. Thus, in the present exemplary embodiment, the first and third subpixel rows may be generally brighter than the second and fourth subpixel rows to the human eye.

In FIG. 2B, the display panel 100 may display a cyan image. For example, with regard to displaying cyan, the green subpixel columns G and the blue subpixel columns B may display a high grayscale level. For example, the red subpixel columns R may display a low grayscale level.

The second data line DL2 shown in FIG. 2B is alternately connected to the first subpixel columns which is the red subpixel columns R and the second subpixel columns which is the green subpixel columns G so that the data voltage outputted through the second data line DL2 swings between a high grayscale level and a low grayscale level.

In contrast, the third data line DL3 shown in FIG. 2B is alternately connected to the second subpixel column which is the green subpixel column G and the third subpixel column which is the blue subpixel column B so that the data voltage outputted through the third data line DL3 maintains a high grayscale level.

The green subpixels P22 and P42 connected to the third data line DL3 which outputs a data voltage maintaining a high grayscale level have charging rates greater than charging rates of the green subpixels P12 and P32 connected to the second data line DL2 which outputs a data voltage swinging between a high grayscale level and a low grayscale level when the green subpixels P12 and P32 connected to the second data line DL2 and the green subpixels P22 and P42 connected to the third data line DL3 have the same target grayscale level. Thus, the green subpixels P22 and P42 connected to the third data line DL3 may be brighter than the green subpixels P12 and P32 connected to the second data line DL2 for the same target grayscale level. Therefore, the green subpixels P22, P25, P28, P42, P45 and P48 in the second and fourth subpixel rows are brighter than the green subpixels P12, P15, P18, P32, P35 and P38 in the first and third subpixel rows for the same target grayscale level.

Among red, green and blue, the color green is the most significant factor to the luminance of the image to a human eye. A next significant factor to the luminance of the image to the human eye is the color red, and the least significant factor to the luminance of the image to the human eye is the color blue. Thus, in the present exemplary embodiment, the second and fourth subpixel rows may be generally brighter than the first and third subpixel rows to the human eye.

In FIG. 2C, the display panel 100 may display a magenta image. For example, the red subpixel columns R and the blue subpixel columns B may display a high grayscale level. For example, the green subpixel columns G may display a low grayscale level.

The second data line DL2 shown in FIG. 2C is alternately connected to the first subpixel column (which is the red subpixel column R), and the second subpixel columns (which is the green subpixel column G), so that the data voltage outputted through the second data line DL2 swings between a high grayscale level and a low grayscale level.

The third data line DL3 shown in FIG. 2C is alternately connected to the second subpixel column (which is the green subpixel column G), and the third subpixel column (which is the blue subpixel column B), so that the data voltage outputted through the third data line DL3 swings between a high grayscale level and a low grayscale level.

The fourth data line DL4 shown in FIG. 2C is alternately connected to the third subpixel column (which is the blue subpixel column B), and the fourth subpixel column (which is the red subpixel column R) so that the data voltage outputted through the fourth data line DL4 maintains a high grayscale level.

In contrast, the fifth data line DL5 is alternately connected to the fourth subpixel column (which is the red subpixel column R), and the fifth subpixel column (which is the green subpixel column G), so that the data voltage outputted through the fifth data line DL5 swings between a high grayscale level and a low grayscale level.

The red subpixels P14 and P34 connected to the fourth data line DL4 which outputs a data voltage maintaining a high grayscale level have charging rates greater than charging rates of the red subpixels P24 and P44 connected to the fifth data line DL5 which outputs a data voltage swinging between a high grayscale level and a low grayscale level when the red subpixels P14 and P34 connected to the fourth data line DL4 and the red subpixels P24 and P44 connected to the fifth data line DL5 have the same target grayscale level. Thus, the red subpixels P14 and P34 connected to the fourth data line DL4 may be brighter than the red subpixels P24 and P44 connected to the fifth data line DL5 for the same target grayscale level. Therefore, the red subpixels P14, P17, P34 and P37 in the first and third subpixel rows are brighter than the red subpixels P24, P27, P44 and P47 in the second and fourth subpixel rows for the same target grayscale level.

Among red, green and blue, green is the most significant factor to the luminance of the image to a human eye. A next significant factor to the luminance of the image to the human eye is red and the least significant factor to the luminance of the image to the human eye is blue. Thus, in the present exemplary embodiment, the first and third subpixel rows may be generally brighter than the second and fourth subpixel rows to the human eye.

Figure 3A:
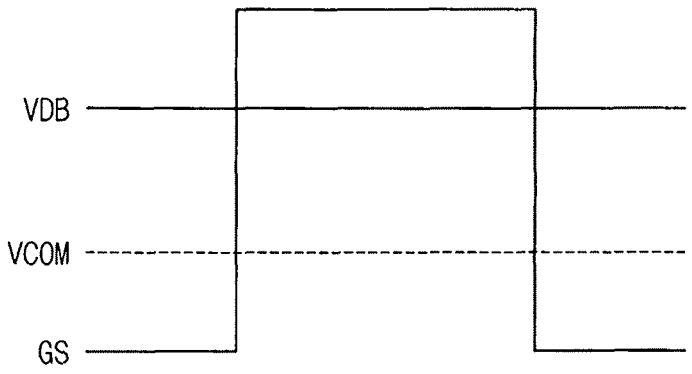
FIGS. 3A and 3B are conceptual diagrams illustrating data signals, and gate signals having unadjusted falling waveforms that are respectively applied to a relatively bright subpixel and a relatively dark subpixel.
Figure 3B:
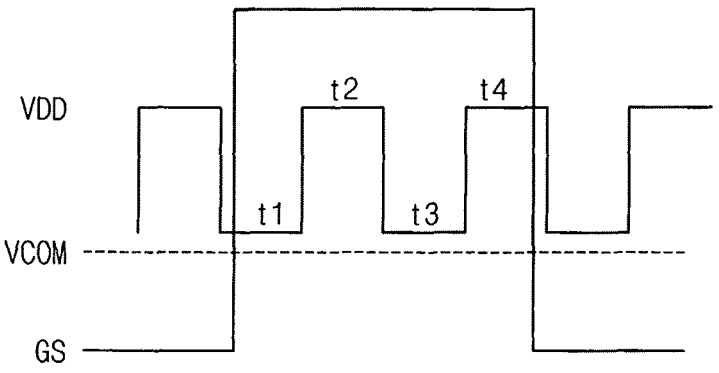

FIGS. 3A and 3B are conceptual diagrams illustrating a relatively bright subpixel and a relatively dark subpixel to which gate signals having unadjusted falling waveforms are respectively applied.

For convenience of explanation, the data voltages VDB and VDD in FIGS. 3A and 3B have a positive polarity with respect to the common voltage VCOM.

FIG. 3A represents that a gate signal having a waveform falling from a high level to a low level at a substantially same time (e.g. the falling edge of the waveform is substantially vertical) is applied to a relatively bright subpixel row. FIG. 3B represents that a gate signal having a waveform falling from a high level to a low level in a moment is applied to a relatively dark subpixel row.

In the example shown in FIGS. 3A and 3B, the gate driver (shown in FIG. 1) does not adjust the falling waveform. In FIG. 3A, the data voltage VDB having a high level is precharged (from t1 to t3) and main-charged (during t4) to the subpixel when the gate signal has a high level. Thus, the subpixel in FIG. 3A has a relatively high charging rate. Precharging may be used in display technology to compensate for insufficient charging time when, for example, a data voltage corresponding to a desired luminance is applied to a subpixel, but the actual subpixel voltage may not reach a target voltage due to insufficient time for charging an LC capacitor CLC. Thus, a subpixel may be precharged before charging (main-charging) by data voltages.

In FIG. 3B, the data voltage VDD having an alternating high and low level is precharged (from t1 to t3) to the subpixel and the data voltage VDD having a high level is finally main-charged (during t4) to the subpixel when the gate signal has a high level. Thus, the subpixel in FIG. 3B which is charged by the alternating high and low level represents a luminance less than the luminance of the subpixel in FIG. 3A, which is charged by the continuous high level.

Figure 4A:
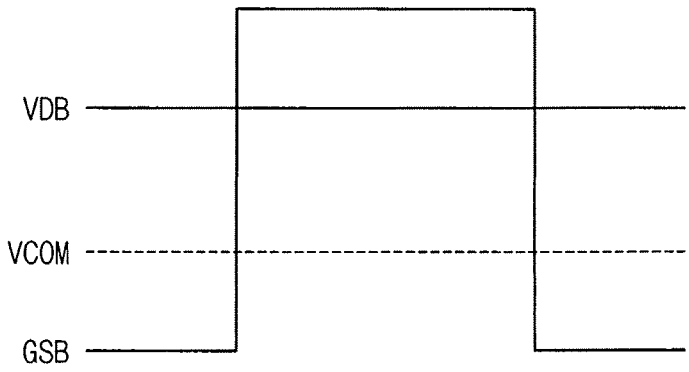
FIGS. 4A and 4B are conceptual diagrams illustrating data signals, and gate signals having adjusted falling waveforms that are respectively applied to a relatively bright subpixel and a relatively dark subpixel by a gate driver of FIG. 1.
Figure 4B:
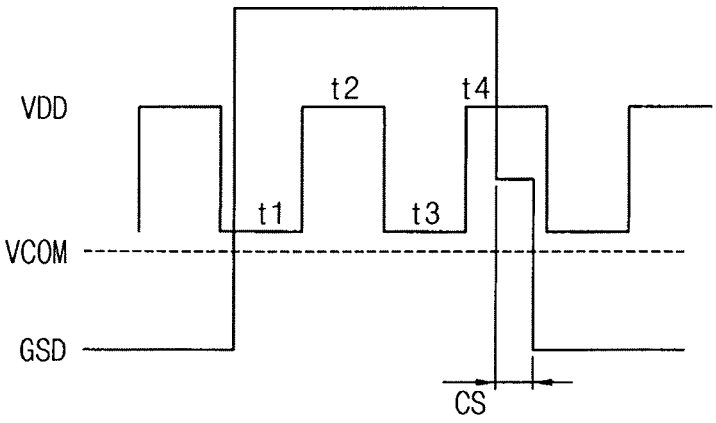

FIGS. 4A and 4B are conceptual diagrams illustrating a relatively bright subpixel and a relatively dark subpixel to which gate signals having adjusted falling waveforms are respectively applied by a gate driver of FIG. 1.

For convenience of explanation, the data voltages VDB and VDD in FIGS. 4A and 4B have a positive polarity with respect to the common voltage VCOM.

FIG. 4A shows that a first gate signal GSB having a first falling waveform falling from a high level to a low level in a moment (e.g. the waveform falls at substantially a same point in time) so a substantially vertical fall of the waveform is applied to a relatively bright subpixel row.

In contrast to FIG. 4A, FIG. 4B shows that a second gate signal GSD has a second falling waveform falling from a high level to a low level in a step shape is applied to a relatively dark subpixel row.

In the present exemplary embodiment, the gate driver 300 outputs the first gate signal GSB having the first falling waveform to a first gate line connected to a relatively bright subpixel row and the second gate signal GSD having the second falling waveform that is different from the first falling waveform to a second gate line connected to a relatively dark subpixel row.

Referring again to FIGS. 3A and 3B, if the falling waveform is unadjusted, the subpixel in FIG. 3B precharged by the data voltage having the alternating high and low level has a luminance less than the luminance of the subpixel in FIG. 3A precharged by the data voltage having the continuous high level.

In the present exemplary embodiment, the first gate signal GSB having the first falling waveform falling from a high level to a low level at a substantially same point in time is applied to the relatively bright subpixel. When the first gate signal GSB falls from a high level to a low level at a substantially same point in time, the pixel voltage charged to the subpixel connected to the first gate line also falls due to a kickback effect. Thus, the luminance of the subpixel connected to the first gate line decreases.

In contrast, in the present exemplary embodiment, the second gate signal GSD having the second falling waveform falling from a high level to an intermediate level and from the intermediate level to a low level in a step shape is applied to the relatively dark subpixel. When the second gate signal GSD falls from a high level to an intermediate level and then to a low level in the step shape, the pixel voltage charged to the kickback effect to the subpixel connected to the second gate line decreases. Thus, the luminance of the subpixel connected to the second gate line decreases less than the decrease of the luminance of the subpixel connected to the first gate line.

The falling waveform of the first gate signal GSB and the second gate signal GSD are differently set, so that the kickback effect of the pixel voltage of the subpixel to which the first gate signal GSB is applied may be different from the kickback effect of the pixel voltage of the subpixel to which the second gate signal GSD is applied. Thus, the difference of the luminance of the subpixel to which the first gate signal GSB is applied and the luminance of the subpixel to which the second gate signal GSD is applied may be compensated.

For example, referring to FIG. 4A, the first falling waveform of the first gate signal GSB may be adjusted by a first charge sharing period when the first gate signal GSB falls. In the present exemplary embodiment, as shown in FIG. 4A, the first falling waveform may not have a charge sharing period.

For example, the second falling waveform of the second gate signal GSD may be adjusted by a second charge sharing period when the second gate signal GSD falls. In the present exemplary embodiment, as shown in FIG. 4B, the second falling waveform may have a charge sharing period CS. The charge charging period CS is a width (e.g. duration) of the step shape.

According to an embodiment of the inventive concept, a shifting of the occurrence of the falling waveform so that the first falling waveform and the second falling waveform have a phase difference, the effects of the kickback voltage to cause display of an artifact may be lessened. This shifting of the falling waveform can occur by having a phase difference in phase clock signals for each pair of gate lines.

In addition, by having a step in the falling waveform, so that the voltage level does not drop from high to low at a substantially same point in time, but rather is first reduced from a high level to an intermediate level, and then from an intermediate level to a low level, the effects of the different charge rates of the pixels will be less, and there may not be an artifact displayed.

When there are first waveform falls and second waveform falls of respective first and second gate lines, utilizing a step shape on the row of subpixels having a lower luminance, and/or widening a duration of the step shape of the falling waveform of the row of subpixels on the row of subpixels having the lower luminance are ways to compensate the gate signal with a lower luminance of a pair of gate signals.

In the present exemplary embodiment, the first gate signal GSB and the second gate signal GSD may have a same rising waveform (e.g. the rising waveform of the first gate signal GSB and the second gate signal GSD may be symmetrical).

In the present exemplary embodiment, an activated period of the gate signal may have a high level and a deactivated period of the gate signal may have a low level. If the gate signal has a high level corresponding to the activated period and a low level corresponding to the deactivated period, the falling waveform of the first gate signal GSB and the second gate signal GSD may be differently set (e.g. adjusted) to compensate for brightness variations that may cause the display of artifacts.

Although not shown in figures, in contrast, if the gate signal has a low level corresponding to the activated period and a high level corresponding to the deactivated period, a rising waveform of the first gate signal GSB and the second gate signal GSD may be differently set. Thus, the kickback effect of the pixel voltage of the subpixel to which the first gate signal GSB is applied may be different from the kickback effect of the pixel voltage of the subpixel to which the second gate signal GSD is applied.

Figure 5A:
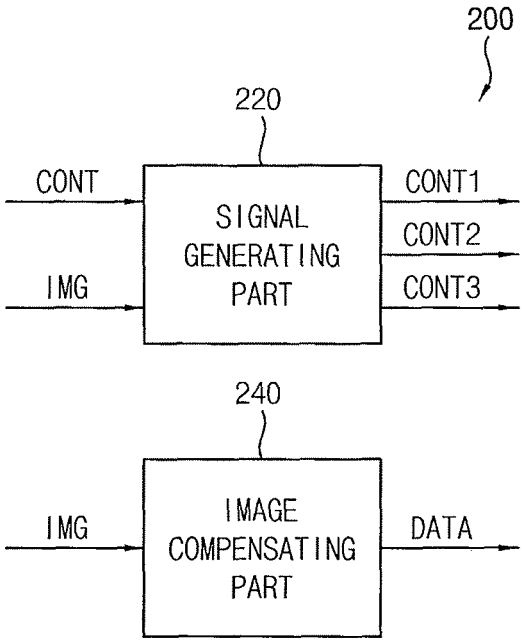
FIG. 5A is a block diagram illustrating a timing controller of FIG. 1.
Figure 5B:
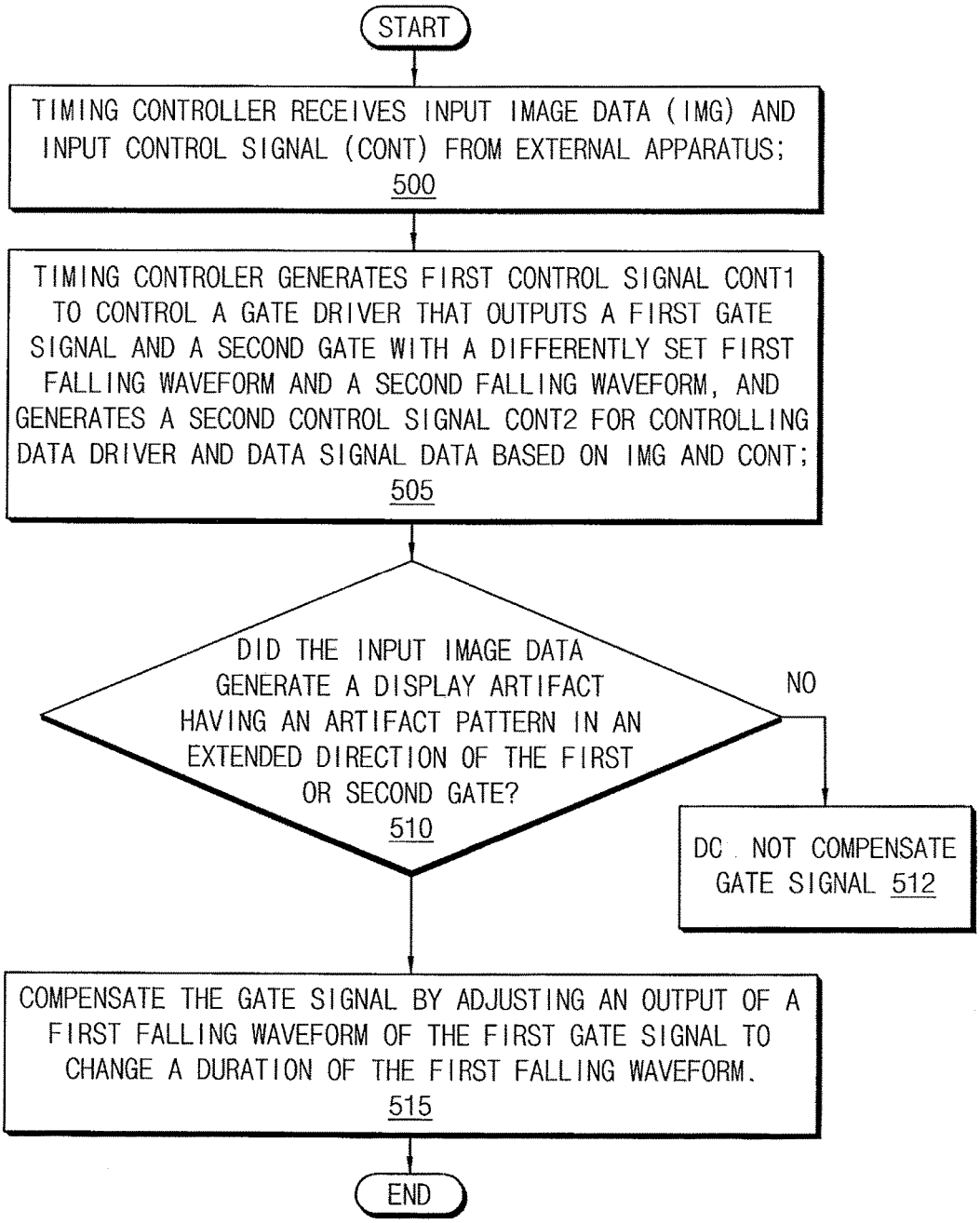
FIG. 5B is a flowchart that illustrates an embodiment of the inventive concept.

FIG. 5A is a block diagram illustrating the timing controller 200 of FIG. 1. FIG. 5B is a flowchart illustrating an exemplary embodiment of the inventive concept. FIG. 6 is a timing diagram illustrating gate clock signals applied to the gate driver of FIG. 1.

Referring to FIGS. 1 to 6, the timing controller 200 includes a signal generating part 220 and an image compensating part 240.

The signal generating part 220 generates the first control signal CONT1 based on the input control signal CONT and outputs the first control signal CONT1 to the gate driver 300. The signal generating part 220 also generates the second control signal CONT2 based on the input control signal CONT and outputs the second control signal CONT2 to the data driver 500. In addition, the signal generating part 220 generates the third control signal CONT3 based on the input control signal CONT and outputs the third control signal CONT3 to the gamma reference voltage generator 400.

The signal generating part 220 of the timing controller may determine whether or not to compensate the gate signal according to the input image data IMG displayed on the display panel 100. When the input image data IMG displays an artifact extending in a direction of the first gate line and the second gate line, the signal generating part 220 may determine that the gate signal is to be compensated.

The first control signal CONT1 may include a gate clock signal. The signal generating part 220 may generate the gate clock signal provided with first control signal CONT1 that is output to the gate driver 300. The first gate signal GSB may be generated based on a first gate clock signal (e.g. CK1) having the first falling waveform. The second gate signal GSD may be generated based on a second gate clock signal (e.g. CK2) having the second falling waveform.

The gate driver 300 may generate the first gate signal GSB based on the first gate clock signal CK1 having the first falling waveform and outputs the first gate signal GSB to the first gate line.

In addition, the gate driver 300 generates the second gate signal GSD based on the second gate clock signal CK2 having the second falling waveform and outputs the second gate signal GSD to the second gate line.

FIG. 5B is a flow chart that illustrates an embodiment of the inventive concept in conjunction with FIGS. 1 and 5A.

At operation 500, the timing controller 200 (shown in FIG. 1) receives an input image data (IMG) and an input control signal from an external apparatus.

At operation 505, the timing controller generates a first control signal CONT1 to control a gate driver 300 that outputs a first gate signal and a second gate signal, the first gate signal has a first falling waveform that is differently set from and a second falling waveform of the second gate signal. As also shown in FIG. 5A, the signal generating part 220 of the image controller 200 receives the external CONT and IMG and outputs, in that example, three control signals. The second control signal (CONT2) is output to the data driver 500, and an image compensating part 240 of the timing controller 200 also outputs data to the data driver.

At operation 510, the timing controller 200 determines whether the input image data IMG generates a display artifact having an artifact pattern extending in a direction of the first gate line or second gate line GL. If no artifact pattern is generated, then no compensation if performed (operation 512).

However, if the timing controller 200 at operation 510 determines that a display artifact pattern has been generated in an extended direction of the first or second gate, the timing controller may determine that the gate signal is to be compensated, and at operation 515, compensates the gate signal, for example, by adjusting an output of a first falling waveform of the first gate signal to change a duration of the first falling waveform.

An artisan should understand and appreciate that the flow chart of FIG. 5B is but one way there can be a compensation of gate signal. While the example was directed to adjusting a first falling waveform, the inventive concept includes compensation may be performed on a first rising waveform of a gate signal.

Figure 6:
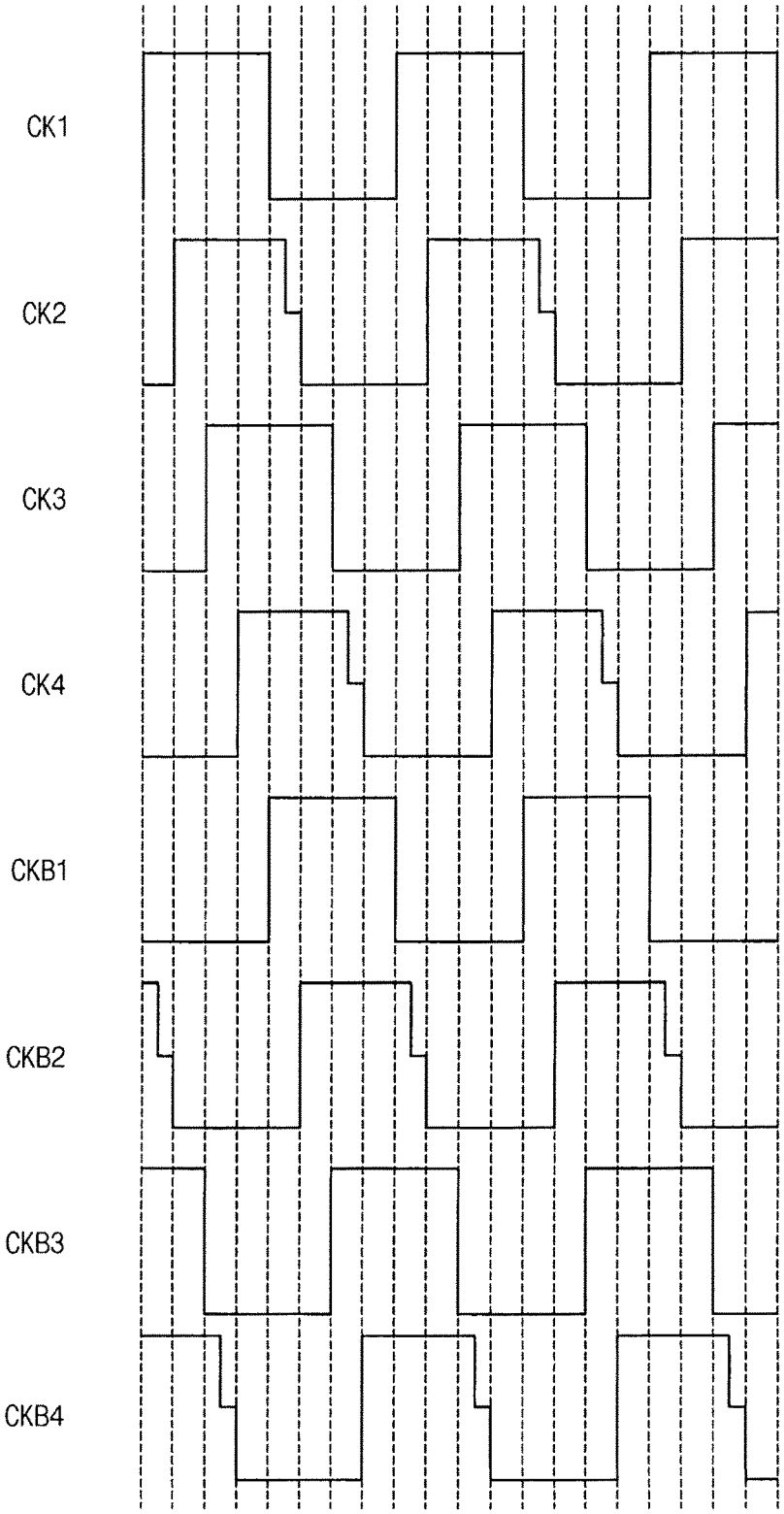
FIG. 6 is a timing diagram illustrating gate clock signals applied to the gate driver of FIG. 1.

Gate clock signals CK1, CK2, CK3, CK4, CKB1, CKB2, CKB3 and CKB4 having four pairs of phases are illustrated in FIG. 6. For example, a gate signal generated based on a first gate clock signal CK1 having a first waveform may be applied to a first gate line GL1. For example, a gate signal generated based on a second gate clock signal CK2 having a second waveform may be applied to a second gate line GL2. It can be seen in FIG. 6 that in this example, that the clock signals CK2, CK4, CKB2, CKB4 have a step-shape on the falling edge of the waveform. Each of the pairs also shows a phase shift.

Moreover, a gate signal generated based on a third gate clock signal CK3 having a third waveform may be applied to a third gate line GL3. For example, a gate signal generated based on a fourth gate clock signal CK4 having a fourth waveform may be applied to a fourth gate line GL4. For example, a gate signal generated based on a fifth gate clock signal (e.g. CKB1) having a fifth waveform may be applied to a fifth gate line. For example, a gate signal generated based on a sixth gate clock signal (e.g. CKB2) having a sixth waveform may be applied to a sixth gate line. For example, a gate signal generated based on a seventh gate clock signal (e.g. CKB3) having a seventh waveform may be applied to a seventh gate line. For example, a gate signal generated based on an eighth gate clock signal (e.g. CKB4) having an eighth waveform may be applied to an eighth gate line. In this example, clock signals 5 through 8 are the signals CKB1 through CKB4).

The gate signals may be repeatedly generated in a cycle of eight gate lines. For example, a gate signal generated based on the first gate clock signal CK1 may be applied to a ninth gate signal. For example, a gate signal generated based on the second gate clock signal CK2 may be applied to a tenth gate signal.

With reference to FIG. 5A, the image compensating part 240 compensates the input image data IMG to generate a data signal DATA. The image compensating part 240 may include, for example, an adaptive color correction part and a dynamic capacitance compensation part.

The adaptive color correction part receives the input image data IMG and operates an adaptive color correction ("ACC"). The adaptive color correction part may compensate the input image data IMG using a gamma curve.

The dynamic capacitance compensation part operates a dynamic capacitance compensation ("DCC") compensating grayscale data of a present frame data using a previous frame data and the present frame data.

According to the present exemplary embodiment, the waveform of the gate signal applied to the gate line is compensated according to the input image data IMG so that the artifact due to the difference of the charging rates between pixels may be prevented. Thus, the display quality of the display panel 100 may be increased.

Figure 7A:
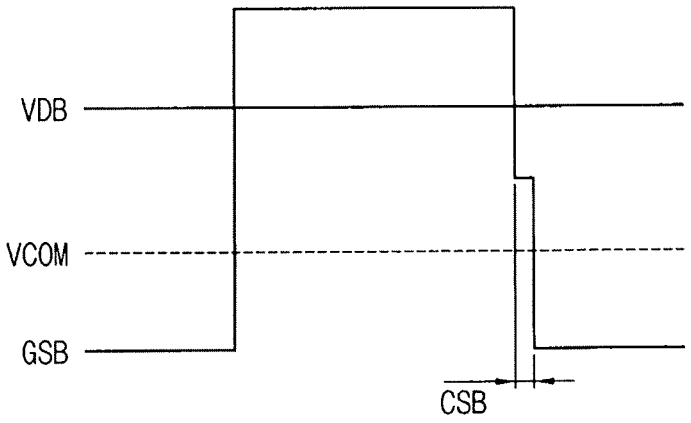
FIGS. 7A and 7B are conceptual diagrams illustrating data signals, and gate signals having adjusted falling waveforms are respectively applied to a relatively bright subpixel and a relatively dark subpixel by a gate driver according to an exemplary embodiment of the present inventive concept.
Figure 7B:
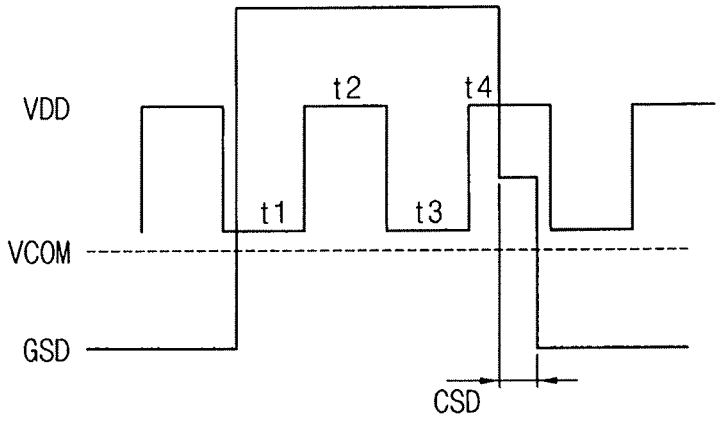
Figure 8:
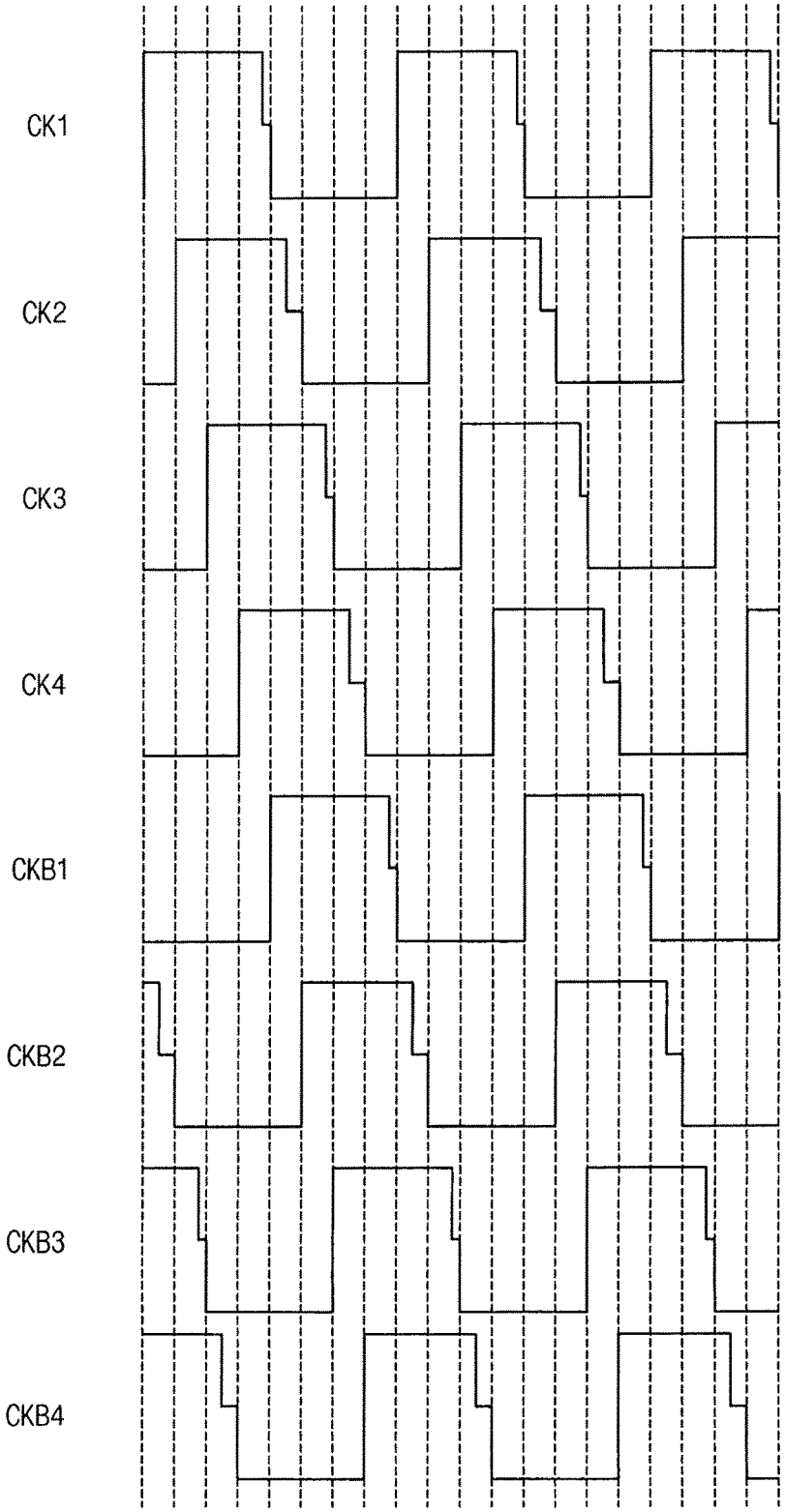
FIG. 8 is a timing diagram illustrating gate clock signals applied to the gate driver of FIG. 1.

FIGS. 7A and 7B are conceptual diagrams illustrating a relatively bright subpixel and a relatively dark subpixel to which gate signals having adjusted falling waveforms that are respectively applied by a gate driver according to an exemplary embodiment of the present inventive concept. FIG. 8 is a timing diagram illustrating gate clock signals applied to the gate driver of FIGS. 7A and 7B.

Referring to FIGS. 1, 2, 5, 7A to 8, the display apparatus includes a display panel 100 and a display panel driver. The display panel driver may include a timing controller 200, a gate driver 300, a gamma reference voltage generator 400 and a data driver 500.

When the input image data IMG generate a luminance difference due to the difference of charging rates between subpixels, the timing controller 200 may determine that the gate signal is to be compensated. For example, when the input image data IMG generate a display artifact having an artifact pattern extending in a direction of the gate line GL, the timing controller 200 may determine to compensate the gate signal.

For convenience of explanation, the data voltages VDB and VDD in FIGS. 7A and 7B have a positive polarity with respect to the common voltage VCOM.

FIG. 7A represents that a first gate signal GSB having a first falling waveform falling from a high level to an intermediate level and from the intermediate level to a low level in a step shape having a first duration CSB that is applied to a relatively bright subpixel row. FIG. 7B represents that a second gate signal GSD having a second falling waveform falling from a high level to an intermediate level and from the intermediate level to a low level in a step shape having a second duration CSD that is longer than the first duration CSB. The second gate signal GSD having the step shape duration CSD is applied to a relatively dark subpixel row.

In the present exemplary embodiment, the gate driver 300 outputs the first gate signal GSB having the first falling waveform to a first gate line connected to a relatively bright subpixel row and the second gate signal GSD having the second falling waveform different from the first falling waveform to a second gate line connected to a relatively dark subpixel row.

As illustrated referring to FIGS. 3A and 3B, if the falling waveform is unadjusted, the subpixel in FIG. 3B precharged by the data voltage having the alternating high and low level has a luminance less than the luminance of the subpixel in FIG. 3A precharged by the data voltage having the continuous high level.

In the present exemplary embodiment, the first gate signal GSB having the first falling waveform falling from the high level to the intermediate level and from the intermediate level to the low level in a step shape in the first duration CSB is applied to the relatively bright subpixel. When the first gate signal GSB falls from the high level to the intermediate level and from the intermediate level to the low level having the first duration CSB, the pixel voltage charged to the subpixel connected to the first gate line also falls due to a kickback effect. Thus, the luminance of the subpixel connected to the first gate line decreases.

In contrast, in the present exemplary embodiment, the second gate signal GSD having the second falling waveform falling from the high level to the intermediate level and from the intermediate level to the low level in a step shape having the second duration CSD is applied to the relatively dark subpixel. When the second gate signal GSB falls from the high level to the intermediate level and from the intermediate level to the low level in the second duration CSD, the pixel voltage charged to the kickback effect to the subpixel connected to the second gate line decreases. However, the luminance of the subpixel connected to the second gate line decreases less than the decrease of the luminance of the subpixel connected to the first gate line.

The falling waveform of the first gate signal GSB and the second gate signal GSD are differently set, so that the kickback effect of the pixel voltage of the subpixel to which the first gate signal GSB is applied may be different from the kickback effect of the pixel voltage of the subpixel to which the second gate signal GSD is applied. Thus, the difference of the luminance of the subpixel to which the first gate signal GSB is applied and the luminance of the subpixel to which the second gate signal GSD is applied may be compensated.

For example, the first falling waveform of the first gate signal GSB may be adjusted by a first charge sharing period CSB when the first gate signal GSB falls. In the present exemplary embodiment, the first falling waveform may have the first charge sharing period CSB which is shorter than the second charge sharing period CSD. The difference in the duration of the first charge sharing period CSB and the second charge sharing period CSD may provide compensation to the luminance of the subpixel.

For example, the second falling waveform of the second gate signal GSD may be adjusted by a second charge sharing period when the second gate signal GSD falls. In the present exemplary embodiment, the second falling waveform may have the second charge sharing period CSD which is longer than the first charge sharing period CSB.

In the present exemplary embodiment, the first gate signal GSB and the second gate signal GSD may have a same rising waveform.

The signal generating part 220 (see FIG. 5A) of the timing controller 200 may generate the gate clock signal. The first gate signal GSB may be generated based on a first gate clock signal (e.g. CK1) having the first falling waveform. The second gate signal GSD may be generated based on a second gate clock signal (e.g. CK2) having the second falling waveform.

The gate driver 300 generates the first gate signal GSB based on the first gate clock signal CK1 having the first falling waveform and outputs the first gate signal GSB to the first gate line.

The gate driver 300 generates the second gate signal GSD based on the second gate clock signal CK2 having the second falling waveform and outputs the second gate signal GSD to the second gate line.

Gate clock signals CK1, CK2, CK3, CK4, CKB1, CKB2, CKB3 and CKB4 having four pairs of phases are illustrated in FIG. 8.

According to the present exemplary embodiment, the waveform of the gate signal applied to the gate line is compensated according to the input image data IMG so that the artifact duet to the difference of the charging rates between pixels may be prevented. The gate clock signals CK1, CK2, CK3, CK4, etc. have a step shape on the falling waveform. Thus, the display quality of the display panel 100 may be increased.

Figure 9A:
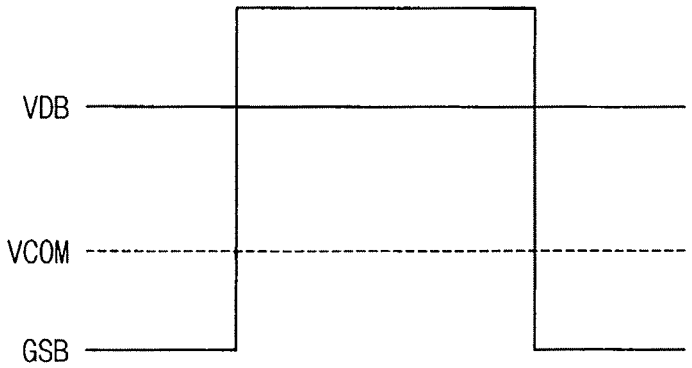
FIGS. 9A and 9B are conceptual diagrams illustrating a relatively bright subpixel and a relatively dark subpixel to which gate signals having adjusted falling waveforms are respectively applied by a gate driver according to an exemplary embodiment of the present inventive concept.
Figure 9B:
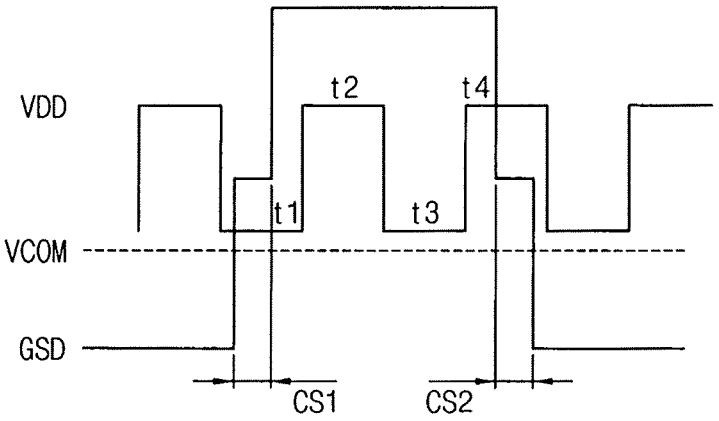
Figure 10:
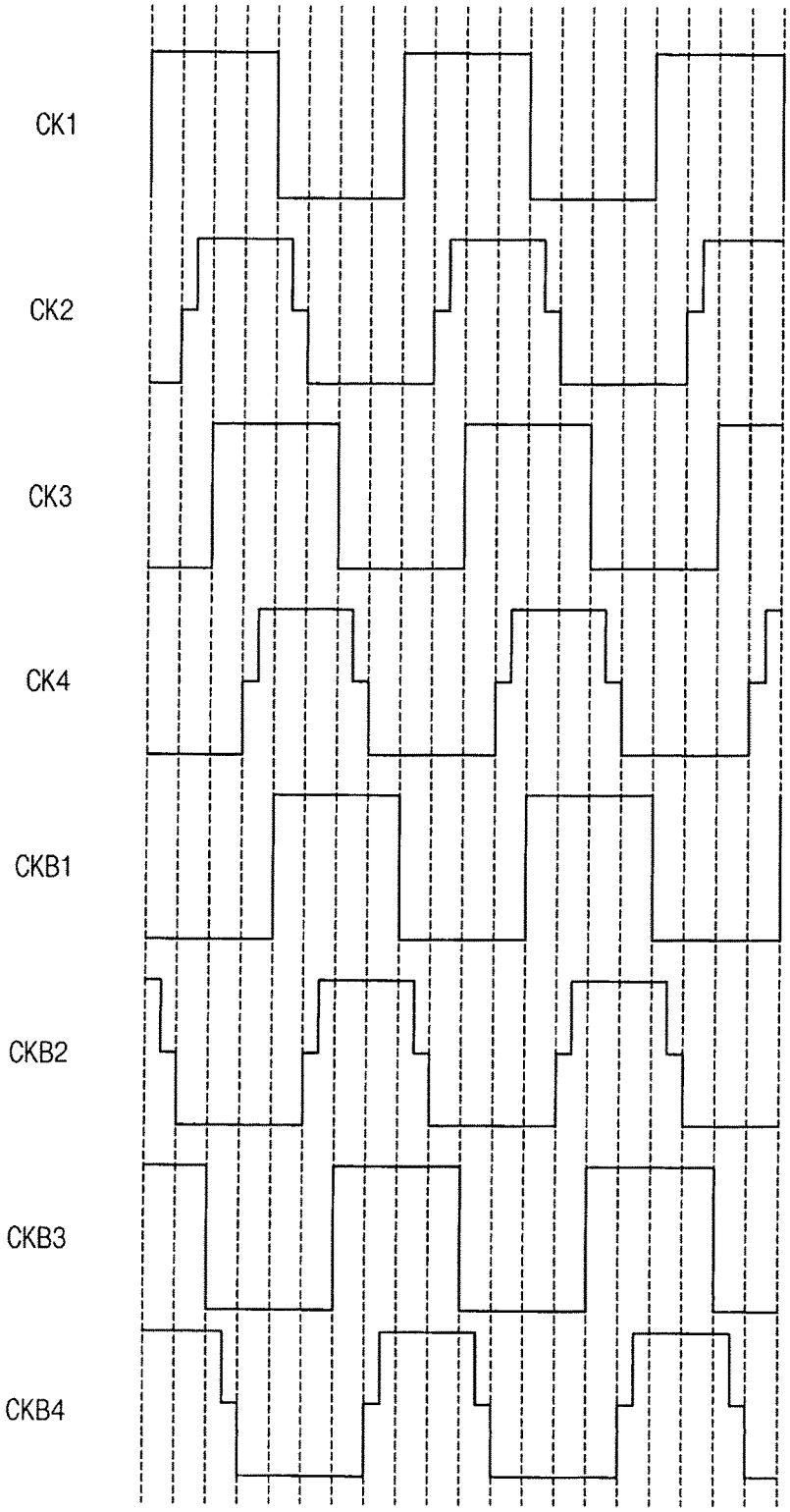
FIG. 10 is a timing diagram illustrating gate clock signals applied to the gate driver of FIG. 1.

FIGS. 9A and 9B are conceptual diagrams illustrating a relatively bright subpixel and a relatively dark subpixel to which gate signals having adjusted falling waveforms that are respectively applied by a gate driver according to an exemplary embodiment of the present inventive concept. FIG. 10 is a timing diagram illustrating gate clock signals applied to the gate driver of FIGS. 9A and 9B.

Referring to FIGS. 1, 2, 5, 9A to 10, the display apparatus includes a display panel 100 and a display panel driver. The display panel driver may include a timing controller 200, a gate driver 300, a gamma reference voltage generator 400 and a data driver 500.

When the input image data IMG generate luminance difference due to the difference of charging rates between subpixels, the timing controller 200 may determine that the gate signal is to be compensated. For example, when the input image data IMG generate a display artifact having an artifact pattern extending in a direction (of the extending direction) of the gate line GL, the timing controller 200 may determine to compensate the gate signal.

For convenience of explanation, the data voltages VDB and VDD in FIGS. 9A and 9B have a positive polarity with respect to the common voltage VCOM.

FIG. 9A represents that a first gate signal GSB having a first falling waveform falling from a high level to a low level in a moment is applied to a relatively bright subpixel row. FIG. 9B represents that a second gate signal GSD having a second falling waveform falling from a high level to an intermediate level and from the intermediate level to a low level in a step shape is applied to a relatively dark subpixel row.

In the present exemplary embodiment, the gate driver 300 outputs the first gate signal GSB having the first falling waveform to a first gate line connected to a relatively bright subpixel row and the second gate signal GSD having the second falling waveform differently set from the first falling waveform to a second gate line connected to a relatively dark subpixel row.

In the present exemplary embodiment, the first gate signal GSB has a first rising waveform and the second gate signal GSD has a second rising waveform different from the first rising waveform.

For example, the first rising waveform of the first gate signal GSB may be symmetric with the first falling waveform of the first gate signal GSB. For example, the second rising waveform of the second gate signal GSD may be symmetric with the second falling waveform of the second gate signal GSD.

For example, the first falling waveform of the first gate signal GSB may be adjusted by a first falling charge sharing period when the first gate signal GSB falls. In the present exemplary embodiment, the first falling waveform may not have a falling charge sharing period. Alternatively, as shown in FIG. 7A, the first falling waveform of the first gate clock signal GSB may have a falling charge sharing period (CSB) shorter than a falling charge sharing period (CSD) of the second falling waveform of the second gate clock signal GSD.

For example, with reference to FIGS. 9A and 9B, the second falling waveform of the second gate signal GSD may be adjusted by a second falling charge sharing period when the second gate signal GSD falls. In the present exemplary embodiment, the second falling waveform may have a falling charge sharing period CS2.

For example, the first rising waveform of the first gate signal GSB may be adjusted by a first rising charge sharing period when the first gate signal GSB rises. In the present exemplary embodiment, the first rising waveform may not have a rising charge sharing period. Alternatively, similar to FIG. 7A, the first rising waveform of the first gate clock signal GSB may have a rising charge sharing period shorter than a rising charge sharing period of the second rising waveform of the second gate clock signal GSD.

For example, the second rising waveform of the second gate signal GSD may be adjusted by a second rising charge sharing period when the second gate signal GSD falls. In the present exemplary embodiment, the second rising waveform may have a rising charge sharing period CS1.

The signal generating part 220 generates the gate clock signal. The first gate signal GSB may be generated based on a first gate clock signal (e.g. CK1) having the first rising waveform and the first falling waveform. The second gate signal GSD may be generated by a second gate clock signal (e.g. CK2) having the second rising waveform and the second falling waveform.

The gate driver 300 generates the first gate signal GSB based on the first gate clock signal CK1 having the first rising waveform and the first falling waveform and outputs the first gate signal GSB to the first gate line.

In addition, the gate driver 300 generates the second gate signal GSD based on the second gate clock signal CK2 having the second rising waveform and the second falling waveform and outputs the second gate signal GSD to the second gate line.

Gate clock signals CK1, CK2, CK3, CK4, CKB1, CKB2, CKB3 and CKB4 having four pairs of phases are illustrated in FIG. 10.

According to the present exemplary embodiment, the waveform of the gate signal applied to the gate line is compensated according to the input image data IMG so that the artifact duet to the difference of the charging rates between pixels may be prevented. Thus, the display quality of the display panel 100 may be increased.

According to the present exemplary embodiment of the inventive concept, a display quality of the display panel may be increased.

The foregoing is illustrative of the present inventive concept and is not to be construed as limiting thereof. Although a few exemplary embodiments of the present inventive concept have been described, those skilled in the art will readily appreciate that many modifications are possible in the exemplary embodiments without materially departing from the novel teachings of the present inventive concept. Accordingly, all such modifications are intended to be included within the scope of the present inventive concept as defined in the claims. Therefore, it is to be understood that the foregoing is illustrative of the present inventive concept and is not to be construed as limited to the specific exemplary embodiments disclosed, and that modifications to the disclosed exemplary embodiments, as well as other exemplary embodiments, are intended to be included within the scope of the appended claims. The present inventive concept is defined by the following claims, with equivalents of the claims to be included therein.

What is claimed is:

1. A method of driving a display panel, the method comprising:

determining whether to compensate a first gate signal according to an input image data displayed on a display panel having a first subpixel column configured to represent a first primary color, a second subpixel column configured to represent a second primary color, and a third subpixel column configured to represent a third primary color;

transmitting the first gate signal having a first falling waveform to a first gate line and a second gate signal having a second falling waveform differently set from the first falling waveform to a second gate line;

adjusting the first falling waveform of the first gate signal in response to determining the first gate signal is to be compensated; and transmitting data voltages to a plurality of data lines;

alternately connecting a single data line of the display panel to subpixels in two of said subpixel columns, and determining that the first gate signal is to be compensated when the input image data represents one of a first secondary color, a second secondary color, or a third secondary color.

2. The method of claim 1, wherein the first and second gate lines extend in a first direction and the plurality of data lines extend in a second direction crossing the first direction, and determining whether to compensate the first gate signal includes identifying when the input image data generates a display artifact having an artifact pattern extending in the first direction of the first and second gate lines.

3. The method of claim 2, wherein:

the first subpixel column is configured to represent a red color, the second subpixel column is configured to represent a green color, and the third subpixel column is configured to represent a blue color, and determining the first gate signal is to be compensated when the input image data represents one of a yellow image, a cyan image and a magenta image.

4. The method of claim 1, wherein adjusting the first falling waveform of the first gate signal includes changing a first gate clock signal having the first falling waveform to prolong a duration in which the first falling waveform changes from a high level to a low level.

5. The method of claim 1, wherein the first gate signal having the first falling waveform is generated based on a first gate clock signal having the first falling waveform, and the second gate signal having the second falling waveform is generated based on a second gate clock signal having the second falling waveform.

6. The method of claim 5, wherein the first falling waveform of the first gate clock signal is determined by a first charge sharing period when the first gate clock signal falls, and the second falling waveform of the second gate clock signal is determined by a second charge sharing period when the second gate clock signal falls.

7. The method of claim 6, wherein the first charge sharing period has a different duration than the second charge sharing period.

8. The method of claim 1, wherein the first falling waveform falls from a high level to a low level at a substantially same time and the second falling waveform falls from the high level to an intermediate level during a first duration of time and from the intermediate level to the low level in a step shape during a second duration of time when a first subpixel row to which the first gate signal is applied is brighter than a second subpixel row to which the second gate signal is applied for a same target luminance.

9. The method of claim 1, wherein the first gate signal has a first rising waveform, and the second gate signal has a second rising waveform different from the first rising waveform.

10. The method of claim 9, wherein the first rising waveform is symmetrical with the first falling waveform, and the second rising waveform is symmetrical with the second falling waveform.

11. A method of driving a display panel, the method comprising:

determining whether to compensate a first gate signal according to an input image data displayed on a display panel;

transmitting the first gate signal having a first falling waveform to a first gate line and a second gate signal having a second falling waveform differently set from the first falling waveform to a second gate line;

adjusting the first falling waveform of the first gate signal in response to determining the first gate signal is to be compensated; and transmitting data voltages to a plurality of data lines, wherein the first falling waveform is adjusted to fall from a high level to an intermediate level and to fall from the intermediate level to a low level in a step shape in a first duration, and the second falling waveform falls from the high level to the intermediate level and from the intermediate level to the low level in a step shape in a second duration which is longer than the first duration when a first subpixel row to which the first gate signal is applied is brighter than a second subpixel row to which the second gate signal is applied for a same target luminance.

12. A display apparatus comprising:

a display panel comprising a plurality of gate lines extending in a first direction, a plurality of data lines extending in a second direction crossing the first direction, and a plurality of subpixels connected to the gate lines and the data lines, said subpixels arranged in a first subpixel column configured to represent a first primary color, a second subpixel column configured to represent a second primary color, and a third subpixel column configured to represent a third primary color;

a timing controller configured to determine whether to compensate a first gate signal according to an input image data displayed on the display panel;

a gate driver configured to transmit the first gate signal having a first falling waveform to a first gate line and a second gate signal to a second gate line, the second gate signal having a second falling waveform different from the first falling waveform in which the first falling waveform is adjusted when the timing controller determines the first gate signal is to be compensated; and a data driver configured to transmit data voltages to the data lines, wherein a single data line of the display panel is alternately connected to the subpixels in two of said subpixel columns, and the timing controller is configured to determine to compensate the first gate signal when the input image data represent one of a first secondary color, a second secondary color, or a third secondary color.

13. The display apparatus of claim 12, wherein the timing controller is configured to determine whether to compensate the first gate signal when the input image data generate a display artifact having an artifact pattern extending in the first direction of the first and second gate lines.

14. The display apparatus of claim 13, wherein the timing controller is configured to adjust the first falling waveform of the first gate signal by changing a first gate clock signal having the first falling waveform to prolong a duration in which the first falling waveform changes from a high level to a low level.

15. The display apparatus of claim 14, wherein:

the first subpixel column is configured to represent a red color, the second subpixel column is configured to represent a green color, and the third subpixel column is configured to represent a blue color, and the timing controller is configured to determine to compensate the first gate signal when the input image data represent one of a yellow image, a cyan image and a magenta image.

16. The display apparatus of claim 12, wherein the first gate signal having the first falling waveform is generated based on a first gate clock signal having the first falling waveform, and the second gate signal having the second falling waveform is generated based on a second gate clock signal having the second falling waveform.

17. The display apparatus of claim 16, wherein the first falling waveform of the first gate clock signal is determined by a first charge sharing period when the first gate clock signal falls, and the second falling waveform of the second gate clock signal is determined by a second charge sharing period when the second gate clock signal falls.

18. The display apparatus of claim 12, wherein the first falling waveform of the first gate signal falls from a high level to a low level at a substantially same time and the second falling waveform falls from the high level to an intermediate level and from the intermediate level to the low level in a step shape when a first subpixel row to which the first gate signal is applied is brighter than a second subpixel row to which the second gate signal is applied for a same target luminance.

19. The display apparatus of claim 12, wherein the first gate signal has a first rising waveform, and the second gate signal has a second rising waveform differently set from the first rising waveform.

20. The display apparatus of claim 19, wherein the first rising waveform is symmetrical with the first falling waveform, and the second rising waveform is symmetrical with the second falling waveform.

21. A display apparatus comprising:

a display panel comprising a plurality of gate lines extending in a first direction, a plurality of data lines extending in a second direction crossing the first direction, and a plurality of subpixels connected to the gate lines and the data lines;

a timing controller configured to determine whether to compensate a first gate signal according to an input image data displayed on the display panel;

a gate driver configured to transmit the first gate signal having a first falling waveform to a first gate line and a second gate signal to a second gate line, the second gate signal having a second falling waveform different from the first falling waveform in which the first falling waveform is adjusted when the timing controller determines the first gate signal is to be compensated; and a data driver configured to transmit data voltages to the data lines, wherein the timing controller adjusts a first clock signal so that the first falling waveform falls from a high level to an intermediate level and from the intermediate level to a low level in a step shape in a first duration and the second falling waveform falls from the high level to the intermediate level and from the intermediate level to the low level in a step shape in a second duration which is longer than the first duration when a first subpixel row to which the first gate signal is applied is brighter than a second subpixel row to which the second gate signal is applied for a same target luminance.

22. A display apparatus comprising:

a display panel comprising a plurality of gate lines extending in a first direction, a plurality of data lines extending in a second direction crossing the first direction, and a plurality of subpixels connected to the gate lines and the data lines;

a timing controller including an image compensation unit and a signal generator, the signal generator is configured to generate at least a first gate clock signal and a second gate clock signal, and the image compensation unit compensates an input image data to generate a data signal;

a gate driver configured to generate a first gate signal and a second gate signal output to respective rows of subpixels in response to receiving the first gate clock signal and the second gate clock signal from the signal generator, a data driver that receives the data signal generated by the image compensation unit and a control signal from the timing controller and converts the data signal into data voltages output to the plurality of data lines;

wherein the first gate signal includes a first rising waveform and a first falling waveform, and the second gate signal includes a second rising waveform and a second falling waveform, and wherein the timing controller adjusts a rising charge sharing period of the first rising waveform by outputting the first clock signal to rise from a low level to an intermediate level during a first duration of time and from the intermediate level to a high level in a step shape during a second duration of time when the timing controller determines that a first subpixel row to which the first gate signal is applied is brighter than a second subpixel row to which the second gate signal is applied for a same target luminance.

23. The display apparatus of claim 22, wherein the timing controller adjusts a falling charge sharing period of the first falling waveform by setting the first clock signal to fall from a high level to an intermediate level during a first duration of time and from the intermediate level to a low level in a step shape during a second duration of time when the timing controller determines that a first subpixel row to which the first gate signal is applied is brighter than a second subpixel row to which the second gate signal is applied for a same target luminance.

* * * * *